US006533824B1

(12) United States Patent
Roper

(10) Patent No.: US 6,533,824 B1
(45) Date of Patent: Mar. 18, 2003

(54) METHOD FOR RESTORING ORIGINAL COLOR TO BLEACHED REGIONS OF NYLON CARPETS

(76) Inventor: Jerry G. Roper, 343 E. 1500 South, Orem, UT (US) 84058

( * ) Notice: Subject to any disclaimer, the term of this patent is extended or adjusted under 35 U.S.C. 154(b) by 0 days.

(21) Appl. No.: 09/501,860

(22) Filed: Feb. 10, 2000

(51) Int. Cl.[7] ..... D06P 5/00; D06P 3/06

(52) U.S. Cl. ..... 8/441; 8/485; 8/504; 8/673; 8/680; 8/924; 8/929

(58) Field of Search ..... 8/441, 401, 485, 8/504, 673, 680, 924, 929

(56) References Cited

U.S. PATENT DOCUMENTS 195,334 A * 9/1877 Besanson
309,124 A * 12/1884 Besanson
5,019,131 A * 5/1991 Nitsch, Jr.

OTHER PUBLICATIONS www.ropersystems.com/userpage, Jul. 26, 2001.*
www.vonschrader.com/equipment/prism/redy/dye.html, Jul. 26, 2001.*

* cited by examiner

*Primary Examiner*—Margaret Einsmann
(74) *Attorney, Agent, or Firm*—Angus C. Fox, III

(57) ABSTRACT

A new method for spot dying nylon carpet requires no color theory nor use of a color wheel. The new method is distinguished from prior art methods primarily by the fact that the focus in on the hue of the spot at any given moment during the process, and that primary dye colors are applied in a sequence determined by the color of the spot. The method has been shown to work on both solid-color and multi-color nylon carpets. It is also effective for spot dyeing light-color (off-white) carpets. The method can also be employed to repair stained areas of a carpet by simply bleaching the stained area and redyeing the bleached area. Prior to the redyeing process, the area to be treated is subjected to several rinse and extract steps. A bleach neutralizer is then applied, allowed to remain on the area to be treated for about 5 minutes, then extracted without further rinsing. For most bleached spots, which will have either white, yellow, or orange hues, the redyeing sequence generally begins with dilute primary blue dye. However, if the bleached spot were to have a blue or green hue, the sequence would preferably begin with dilute primary red dye. On the other hand, if the bleached spot were to have a purple or lavender hue, the sequence would preferably begin with dilute primary yellow. Based on the color of the spot, the bleached area is then sprayed with the appropriate dilute primary color dye, which is then vacuum extracted without rinsing. The spray and extract process is repeated until either the desired color is obtained or the slightest tinge away from the color to be matched is observed. For each primary color dye, it is best to under-dye the area rather than over-dye it for the first application of a particular primary color dye. As the spot changes color, the remaining two primary colors are employed in an order as though the redyeing process were just beginning.

18 Claims, No Drawings

METHOD FOR RESTORING ORIGINAL COLOR TO BLEACHED REGIONS OF NYLON CARPETS

BACKGROUND OF THE INVENTION

1. Field of the Invention

This invention relates generally to methods for spot dyeing nylon carpets and, more particularly, to methods for spot dyeing areas of such carpets that have been bleached.

2. History of the Prior Art

Until the middle of the nineteenth century, nearly all known dyes were obtained from natural sources. Although most were vegetable extracts, a few were animal products. The range of available colors was limited, as was the utility of the available dyes. If a specified natural dye did not bind to a particular material, that dye was ineffectual in changing the color of the material. The era of synthetic dyes began in 1771, when Woulfe prepared picric acid (a.k.a. trinitrophenol) by subjecting indigo to nitric acid. The resultant yellow crystalline solid proved to be a formidable explosive; when solvated, it was shown to dye silk in bright yellow hues. More than half a century passed before Laurent discovered in 1842 that phenol could be converted to picric acid. Fourteen years later, Perkin discovered mauve, a bluish purple dye obtained from aniline. Mauve, the first of the coal-tar dyes, was the first synthetic dye to be manufactured and used for practical dyeing. However, it was not until 1869, when the structure of benzene was established by Kekule, that the way was paved for the study of aromatic organic compounds, from which all synthetic dyes are synthesized. Since that time, a bewildering number of synthetic dyes have been formulated. As the twenty-first century dawns, new synthetic dyes are still being discovered with amazing regularity.

The largest group of dyes have as chromophores what are known as azo compounds—intensely colored aromatics having one or more azo linkages (—N═N—), each of which brings a pair of aromatic rings into conjugation. Each azo linkage gives an extended system of delocalized $\pi$ electrons that is responsible for absorption of light in visible regions. Depending on the number of azo groups present in the molecule, they are classified as monazo, diazo, triazo, tetrakisazo and polyazo dyes. Azo dyes almost always contain one or more $—SO_3^-Na^+$groups, which not only confer water solubility on the dye, but assist in binding the dye to the surfaces of polar fibers, such as silk, wool, cofton, or nylon. Many dyes are made by coupling reactions of naphthylamines and naphthols. "H-acid" (8Amino-1-naphthol-3,6-disulfonic acid) is a particularly versatile component in dye manufacture. Not only does it contain sulfonic acid groups, but it can also couple in two different ways, depending on the pH of the medium.

Silk and wool are two naturally occurring polymers that man has used for centuries to fabricate clothing and carpets. They are both examples of a family of polymer compounds, known as proteins, in which $\alpha$-amino acid subunits are joined by amide linkages. Proteins are, therefore, polyamides. The search for a synthetic material with properties similar to those of silk led to the discovery of a family of synthetic polyamides called nylons. One of the most important nylons, called nylon 6,6, can be prepared from the six-carbon dicarboxylic acid, adipic acid, and the six-carbon diamine, hexamethylene-diamine. In the commercial process, these two compounds are allowed to react in equimolar proportions in order to produce a 1:1 nylon salt.

Water molecules are driven off by heating the nylon salt it to a temperature of 270° C. at a pressure of 250 pounds per square inch, thereby condensing it to the polyamide. The nylon 6,6 so produced, which has a molecular weight of about 10,000 and a melting point of about 250° C., can be spun into fibers when molten. By stretching the fibers to four times their original length, the polyamide molecules orient themselves so that they are parallel to the fiber axis. Such an orientation permits hydrogen bonding between carbonyl groups and amino groups on adjacent chains. This "cold drawing" process greatly increases the strength of the fibers.

The same molecular structure that is responsible for the strength of nylon fibers also results in repeating polarized units on the surface of each fiber. It is this polarization that allows nylon fibers to be readily colored by sulfonic-acid dyes. Typically, one or more organic acid dyes are dissolved in an aqueous solution and the material to be dyed is either sprayed with or immersed in the solution. The physical characteristics of nylon fibers which permit them to be readily dyed, also make them susceptible to staining. Certain FDA-approved food colorings work equally well as nylon fiber dyes. The food colorings are likely responsible for the trashing of millions of dollars worth of nylon carpet annually, with the colors red 40 and red 3 being some of the more notorious culprits. Though it is sometimes possible to remove the food coloring, it is also possible that the carpet dye will be removed at the same time.

Another problem with the dyes used to color nylon fibers is that they are readily oxidized by chlorine bleach and certain peroxides and. Strong bases may reduce one or more of the dyes, either altering or bleaching the color. The damage to carpets caused by inadvertent spills of chlorine bleach, peroxides and strongly basic solutions may be as great as the damage caused by food colorings and other equally persistent stains.

As an alternative to replacing the entire carpet, carpet care professionals have developed certain methods for redyeing the bleached spots. The spot dying methods typically use the same types of acid dyes used by the manufacturers to impart the original color to the carpets. Typically, the conventional redyeing methods employ a color chart or color wheel, and require that a carpet matching spot dye be formulated by combining selected basic dye colors in the proper proportions. Spot dyeing kits are also available that use only the three primary dye colors: red, yellow and blue. The known kits suggest that the dyer begin with the primary color closest to the unbleached carpet color. The major problem with such redyeing methods is that accurate color matching requires a high degree of skill and compentency, as well as luck. In addition, the method suggested whereby the first primary color to be used is the one closest to the unbleached carpet color is flawed, as the suggested primary color may not have been removed by bleaching. As will be hereinafter explained, adding the suggested primary color may simply result in addition of too much of the main primary color dye and make it impossible to achieve a close match.

Although there is a great demand for competent spot dyers, the conventional spot dyeing processes have become so complex, that few individuals are sufficiently patient to learn the required skills. Twenty or more years ago, carpet colors were few and often close in color to a primary color. The then prevailing redyeing method was to use a primary color closest to the original color, and then use color theory to create a match. Though the concept is still in use today, it does not take into consideration that carpet colors are seldom close to a primary color. Additionally, many carpets are so lightly colored that the closest primary color is difficult to determine. As more shades of carpet became available, more color samples were added to spot dyeing kits. As the number of dye colors in spot dyeing kits proliferated, the kits became more expensive and more difficult to competently use. Each carpet is typically dyed with at least two, and typically, three primary dyes, each of which has its own susceptibility to a particular bleaching agent. As a general rule, when a spot on a carpet is bleached, each of the primary dyes is affected differently. For example, a particular bleach may oxidize the primary red color, but have less of an effect on the blue and yellow primary dyes. It a spot dyeing kit were to contain 60 different colors, and a bleached spot on a carpet were missing only one of three primary colors, using a formulation which matched the original color would result in a color mismatch for the area being repaired. All of the foregoing factors combine to make spot dying using conventional techniques a formidable task.

What is needed is a greatly simplified spot dying process that permits individuals having limited color matching skill to restore the proper color to bleached spots on nylon carpet.

SUMMARY OF THE INVENTION

The present invention includes a new method for spot dying nylon carpet. The new method is distinguished from prior art methods primarily by the fact that the focus in on the hue of the spot at any given moment during the process, and that primary dye colors are applied in a sequence determined by the color of the spot at that moment. Using this method, no knowledge of color theory is required, nor is the use of a color wheel. The method has been shown to work on both solid-color and multi-color nylon carpets. It is also effective for spot.dyeing light-color (off-white) carpets. The method can also be employed to repair stained areas of a carpet by simply bleaching the stained area and redyeing the bleached area. The method is simple enough to be employed by most homeowners in spot dyeing their own carpets.

The new spot dyeing method employs primary color acid dyes (namely blue, red and yellow) each of which is in an aqueous solution which includes pH adjusters and dye penetrants. The dyes are diluted and applied in succession. The extent of dilution is roughly determined by the shade of the carpet. Following a prescribed sequence, the dyes are applied gradually until an almost exact match is achieved.

The bleached area to be treated is first subjected to several rinse and extract steps. A bleach neutralizer is then applied, allowed to remain on the area to be treated for about 5 minutes, then extracted without further rinsing.

The sequence to be used to redye a bleached spot of carpet depends on the color of the bleached spot. It can be stated, almost as a maxim, that primary blue dyes are the least stable; primary red dye is the next least stable; and yellow is the most stable. As a consequence, most spots are either white, yellow, or orange. A white spot is generally evidence that all of the original dye has been oxidized (bleached). A yellow colored spot will generally indicate complete or near complete oxidation of primary blue and primary red dye components. An orange colored spot indicates that all or nearly all of the primary blue dye component has been oxidized. For bleached spots having either white, yellow, or orange hues, the redyeing sequence generally begins with primary blue dye. It should be emphasized that, because of the inherent instability of primary blue color dye, nearly every spot redyeing sequence will begin with primary blue. However, if the bleached spot were to have a blue or green hue, the sequence would generally begin with primary red dye. On the other hand, if the bleached spot were to have a purple or lavender hue, the sequence would generally begin with primary yellow. Based on the color of the spot, the bleached area is then sprayed with the appropriate dilute primary color dye. With the base of the fibers exposed using, for example, the index and middle fingers of the same hand, the spot is sprayed again. The sprayed-on dye is then extracted without rinsing. The spray and extract process is repeated until either the desired color is obtained or the slightest tinge away from the color to be matched is observed. For each primary color dye, it is best to under-dye the area rather than over-dye it for the first application of a particular primary color dye. As the spot changes color, the remaining two primary colors are employed in an order as though the redyeing process were just beginning.

DETAILED DISCLOSURE OF THE INVENTION

The new method for spot dying nylon carpet employs the application and extraction of dilute aqueous solutions of acid dyes. The new method is distinguished from prior art methods primarily by the fact that the focus in on the hue of the spot at any given moment during the process, and that primary dye colors (to wit, blue, red and yellow) are applied in a sequence determined by the color of the spot at that moment. Using this method, little or no knowledge of color theory is required, nor is the use of a color wheel. The method has been shown to work on both solid-color and multi-color nylon carpets. It is also effective for spot dyeing off-white color carpets. The method can also be employed to repair stained areas of a carpet by simply bleaching the stained area and redyeing the bleached area.

A concentrated supply formulation for each primary dye color is prepared. The optimum concentration for each concentrated supply formulation is considered to be about 5 grams of powdered dye per liter of water. The concentrated supply formulations are far too concentrated for use as is in the spot dyeing process, and are used for supply purposes only. The supply formulations may also include commercially available dye penetrants and pH adjusters. For spot dyeing medium to dark colored carpets, a standard spot dyeing formulation is prepared by mixing 1 part of the concentrated supply formulation with 250 parts of water. This is equivalent to a concentration of approximately 20 mg of powered dye per liter of water. For light colored (off-white) carpets, a dilute spot dyeing formulation is prepared by further diluting the standard spot dyeing formulations by a factor of 10. The concentrations of the dilute spot dyeing formulations is, thus, approximately 2 mg of powdered dye per liter of water. If in doubt as to whether the carpet color is light or dark, it is better to use the dilute spot dyeing formulations. The process works as well, but simply takes longer, as more applications and extractions will be required.

In addition to the appropriate spot dyeing formulations, a bleach neutralizing solution is prepared by mixing a powdered bleach neutralizer, such as sodium hyposulfate, with water. Solutions of about 0.5–1% sodium hyposulfate by weight are deemed to be the preferred concentrations It should be emphasized that the sequence to be used to redye a bleached spot of carpet depends on the current color state of the bleached spot. It can be stated, almost as a maxim, that primary blue dyes are the least stable; primary red dye is the next least stable; and yellow is the most stable. As a consequence, most spots are either white, yellow, or orange. A white spot is generally evidence that all of the original dye has been oxidized (bleached). A yellow colored spot will generally indicate complete or near complete oxidation of primary blue and primary red dye components. An orange colored spot indicates that all or nearly all of the primary blue dye component has been oxidized. From experience, it has been shown that for about forty percent of the cases where redyeing of nylon carpets is carried out, only blue primary dye has been removed from the spot by the bleach; in about forty percent of the cases, both blue and red primary dyes have been removed; and in about twenty percent of the cases, all three primary dyes have been removed.

Prior to the redyeing process, the area to be redyed is subjected to several rinse and extract steps. The bleach neutralizer solution is then applied, allowed to remain on the area to be treated for about 5 minutes, then extracted without further rinsing.

For bleached spots having either white, yellow, or orange hues, the redyeing sequence generally begins with primary blue dye. The concentration of the dye used for the redyeing process, of course, depends on whether the carpet is light, medium, or dark colored. It should be emphasized that nearly every spot redyeing sequence will begin with primary blue. However, if the bleached spot were to have a blue or green hue, the sequence would preferably begin with primary red dye. On the other hand, if the bleached spot were to have a purple or lavender hue, the sequence would preferably begin with primary yellow. These basic instructions should be varied only when the unbleached color of the carpet is a near match with primary red or primary yellow and the spot is white. In such a case, the dye corresponding to the bleached color, whether red or yellow, is employed to redye the spot.

Based on the color of the spot, the bleached area is then sprayed with the appropriate dilute primary color dye. With the base of the fibers exposed using, for example, the index and middle fingers of the same hand, the spot is sprayed again. The sprayed-on dye is then extracted without rinsing. The spray and extract process is repeated until either the desired color is obtained or the slightest tinge away from the color to be matched is observed. As the spot changes color, the remaining two primary colors are employed in an order as though the redyeing process were just beginning. If a matching hue is obtained that is not sufficiently dark, the process can be repeated multiple times until a color intensity match is also obtained. To be more specific, primary blue dye is applied to a bleached spot having either white, yellow, or orange hues until either the color of the spot matches the unbleached carpet color or it acquires a noticeable blue, green, or purple tinge; primary red dye is applied to a bleached spot having a blue or green hue until either the unbleached carpet color is matched or until a purple, lavender, or orange hue is observed; and primary yellow dye is applied to a bleached spot having a purple or lavender hue until either the unbleached carpet color is matched or a yellow, orange or green hue is observed. For each primary color dye application, it is best to under-dye the area rather than over-dye it, as color can be darkened by subsequent applications. However, color can only be removed by bleaching and beginning the process anew.

White spots on other than blue carpets require some further explanation. Primary blue primary dye is normally applied until a noticeable blue tinge appears. If the bleached spot is truly white, the tinge will have the same hue, or color, as the primary blue dye. If any yellow dye remained in the bleached spot, the blue will have a slight green tinge. After the spot is no longer white, dyeing proceeds in a normal manner.

If the process is performed improperly and a poor match is obtained, the treated spot may be rebleached and the process repeated in the correct manner. It should be mentioned that certain acids, such as dilute sulfuric acid, are excellent oxidizers. Whereas a solution of sodium hypochlorite (i.e., generic chlorine bleach) may not oxidize all three primary colors, dilute sulfuric acid certainly will. In a case where a brown wood stain had been spilled on a carpet, it was necessary to use sulfuric acid in a heated extraction process to remove the stain by bleaching the immediate area before the redyeing process could commence. It should be stressed that whenever an oxidant is employed, whether it be chlorine bleach, sulfuric acid, a peroxide, or strongly basic solution, it must be thoroughly neutralized before the redyeing process begins.

Although only several embodiments of the present invention have been disclosed herein, it will be obvious to those having ordinary skill in the art that changes and modifications may be made thereto without departing from the scope and spirit of the invention as hereinafter claimed.

What is claimed is:

1. A method for restoring an original color to a bleached region of nylon carpet, said method comprising the steps of:

applying to the bleached region at least one primary color acid dye selected from the group consisting of the colors blue, red and yellow, until the original color is restored, selection of a primary color acid dye for each application being a function of the then current color of the bleached region, wherein if the bleached region has a white or yellow or orange hue, primary blue dye is applied thereto until either the color of the region is restored to the original color or the region acquires a noticeable blue or green or purple tinge; or if the bleached region has a blue or green hue, primary red dye is applied thereto until either the color of the region is restored to the original color or the region acquires a noticeable purple or lavender or orange hue; or if the bleached region has a purple or lavender hue, primary yellow dye is applied thereto until either the color of the region is restored to the original color or the region acquires a noticeable yellow or orange or green hue.

2. The method of claim 1, wherein if a hue matching the original color is obtained that is not sufficiently dark, the process is repeated until a color intensity match occurs.

3. The method of claim 1, wherein the bleached region is rinsed and treated with a bleach neutralizing agent prior to the application of any primary color dyes.

4. The method of claim 1, wherein a dry extraction immediately follows the application of each primary color dye.

5. The method of claim 1, wherein each of the primary color acid dyer is diluted to have a concentration of no more than about 20 mg of dye powder per liter of water.

6. The method of claim 1 wherein for dark and medium colored carpets, each of the primary color acid dyes is diluted to have a concentration of no more than about 20 mg of dye powder per liter of water.

7. The method of claim 1 wherein for light colored carpets, each of the primary color acid dyes is diluted to have a concentration of no more than about 2 mg of dye powder per liter of water.

8. A method for spot dying a region of a nylon carpet, where an original color has been partially or completely destroyed by a bleaching agent, in order to restore the original color, said method comprising the steps of:

determining the prevailing hue of the region;

treating the region with an acid dye solution selected from the group consisting of three primary color acid dye solutions, as a function of the region's prevailing hue, wherein, alternatively, a primary blue dye solution is applied to the bleached region if it has white or yellow or orange hues;

a primary red dye solution is applied to the bleached region if it has a blue or green hue;

a primary yellow dye is applied to the bleached region if it has a purple or lavender hue; and wherein if a match between the treated region and the original color is not achieved after a first application of primary color acid dye, at least one subsequent application of primary color acid dye is applied to the treated region as a function of the treated region's non-matching prevailing hue until a desired match is achieved.

9. The method of claim 8, wherein:

the primary blue dye solution is applied to the bleached region until either the original color is restored to the region or the region acquires a noticeable blue, green, or purple tinge;

the primary red dye solution is applied to the bleached region until either the original color is restored to the region or the region acquires a purple, lavender, or orange hue; and the primary yellow dye is applied to the bleached region until either the original color is restored to the region or the region acquires a yellow, orange, or green hue.

10. The method of claim 8, wherein the bleached region is rinsed and treated with a bleach neutralizing agent prior to the application of said at least one primary color dye solutions.

11. The method of claim 8, wherein a dry extraction step immediately follows the application of each primary color dye solution.

12. The method of claim 8, wherein each of the primary color acid dye solutions has a concentration within a range of between about 2 mg to about 20 mg of dye powder per liter of water.

13. The method of claim 12, wherein low concentration dye solutions are used for light colored carpets, medium concentration dye solutions are used for medium colored carpets, and high concentration dye solutions are used for dark colored carpets.

14. The method of claim 9, wherein if a matching hue is obtained that is not sufficiently dark, the process is repeated multiple times until a color intensity match occurs.

15. A method for restoring an original color to a region of nylon carpet which has been bleached, said method comprising the steps of treating the region with successive applications of individual primary color acid dye solutions until a color match between the region and unbleached areas surrounding the region is achieved, a primary color acid dye solution being selected for each application as a function of the current color of the region, wherein:

a primary blue dye solution is applied to the region if it has a white, yellow, or orange hue until either the the region acquires the color of unbleached areas surrounding the region or the region acquires a noticeable blue, green, or purple tinge;

a primary red dye solution is applied to the region if it has a blue or green hue until either the region acquires the color of unbleached areas surrounding the region, or the region acquires a noticeable purple, lavender, or orange hue; and a primary yellow dye solution is applied to the region if it has a purple or lavender hue until either the region acquires the color of unbleached areas surrounding the region, or the region acquires a a yellow, orange, or green hue.

16. The method of claim 15, wherein the bleached region is rinsed and treated with a bleach neutralizing agent prior to the application of the primary color dyes.

17. The method of claim 15, wherein a dry extraction step immediately follows the application of each primary color acid dye.

18. The method of claim 15, wherein each of the primary color acid dyes is diluted to have a concentration of between 2 to 20 mg of dye powder per liter of water, depending on the color intensity of the unbleached carpet.

* * * * *